US005206470A

United States Patent [19]

Hokutou et al.

[11] Patent Number: 5,206,470

[45] Date of Patent: Apr. 27, 1993

[54] OPERATING DEVICE FOR GAS CIRCUIT BREAKER

[75] Inventors: Hiromichi Hokutou, Hitachi; Tetsuo Fukuchi, Hitachiota; Masatomo Ohno; Akira Suzuki, both of Hitachi, all of Japan

[73] Assignee: Hitachi, Ltd., Tokyo, Japan

[21] Appl. No.: 705,531

[22] Filed: May 24, 1991

[30] Foreign Application Priority Data

May 30, 1990 [JP] Japan ..... 2-138226

[51] Int. Cl.[5] ..... H01H 3/24; H01H 33/30; H01H 35/38

[52] U.S. Cl. ..... 200/82 B; 200/148 F

[58] Field of Search ..... 200/82 B, 148 R, 148 A, 200/148 F

[56] References Cited

U.S. PATENT DOCUMENTS

| | | | |
|---|---|---|---|
| 3,564,179 | 2/1971 | Boersma et al. | 200/148 |
| 3,930,134 | 12/1975 | Rostron et al. | 200/82 B |
| 3,984,648 | 10/1976 | Nakano et al. | 200/82 B |
| 4,384,182 | 5/1983 | Imam | 200/82 B |

FOREIGN PATENT DOCUMENTS 54-101168 8/1979 Japan .

*Primary Examiner*—J. R. Scott

*Attorney, Agent, or Firm*—Antonelli, Terry, Stout & Kraus

[57] ABSTRACT

An operating device for a gas circuit breaker includes an operating piston reciprocably movable between a first position and a second position, with the operating piston dividing an internal space of the operating cylinder into a first chamber and a second chamber. An exhaust port in the operating cylinder communicates with the first chamber when the operating piston is disposed near the second position, and the exhaust port communicates with the second chamber when the operating piston is remote from the second position. High-pressure air is introduced into the first chamber at the time of the breaking operation. An exhaust valve device discharges the air from the first chamber when the air pressure within the first chamber decreases below a predetermined level. The exhaust valve device includes a valve element having a pressure-receiving portion receiving the air pressure from the first chamber. The pressure-receiving portion is positioned so as to be out of contact with the operating piston when the operating piston is disposed at the first position.

3 Claims, 3 Drawing Sheets

OPERATING DEVICE FOR GAS CIRCUIT BREAKER

BACKGROUND OF THE INVENTION

1. Field of the Invention

This invention relates generally to an operating device for a gas circuit breaker used in a substation or the like in order to shut off the flow of abnormal current or accidental current, and more particularly, to an operating device of the type at such operable high speed that a time period from the start of the breaking or opening operation of an operating piston to the end of the reclosing operation of the operating piston is about 100 to 150 ms.

2. Description of the Prior Art

One conventional operating device for a gas circuit breaker is disclosed in Japanese Patent Unexamined Publication, No. 54-101168, with the operating device comprising an operating cylinder having an exhaust port at a predetermined position, an operating piston reciprocably movable along the operating cylinder at the time of the breaking (opening) and closing operations, means for introducing high-pressure air into a front chamber of the operating cylinder, disposed on the front side of the operating piston, at the time of the breaking operation, and an exhaust valve (which includes a valve element) operable in response to the air pressure within the front chamber of, the operating cylinder.

In the above described conventional operating device, when the high-pressure air is introduced into the front chamber at the time of the breaking operation, the exhaust valve is closed by the movement of the valve element, so that the air can not be discharged from the front chamber. It is not until after the operating piston moves a considerable distance from the time of start of the breaking operation that the exhaust port of the operating cylinder is communicated with a rear chamber of the operating cylinder disposed on the rear side of the operating piston. Therefore, as the operating piston moves, the air within the front chamber is not discharged, whereas, the air within the rear chamber is discharged therefrom via the exhaust port. Therefore, the operating piston can be moved at high speed to thereby carry out the breaking operation at high speed.

When the operating piston moves near the position where the breaking operation is completed, the exhaust port is isolated from the rear chamber, and is communicated with the front chamber, so that the high pressure air within the front chamber is discharged therefrom. When the pressure within the front chamber decreases below a predetermined level, the exhaust valve is opened by the movement of the valve element, so that the pressure within the front chamber is further decreased. Therefore, when the breaking operation is completed, the pressure within the front chamber is sufficiently low, and therefore the re-closing operation can be carried out in an extremely short time period after the completion of the breaking operation, and besides this closing operation can be effected at high speed.

As described above, the above conventional operating device for the gas circuit breaker is suited for carrying out the operation from the start of the breaking operation to the end of the re-closing operation at high speed. However, this operating device has the following disadvantages.

The exhaust valve is arranged in an eccentric relationship with respect to the axis (centerline) of a rod of the operating piston, and when the valve element is in the position to open the exhaust valve, a pressure-receiving portion, formed at the distal end of the valve element of the exhaust valve, is urged by a spring to be projected into the front chamber of the operating cylinder. When the closing operation is completed, the operating piston urges the pressure receiving portion of the valve element against the bias of the spring so as to move the valve element to the position to close the exhaust valve. Thereafter, until the high-pressure air is introduced into the front chamber, the valve element is held by the operating piston in the latter position. With this arrangement wherein the operating piston mechanically urges or pushes the pressure-receiving portion of the valve element, the reliability of the movement of the valve element may be lowered, and also this may cause damage to the sliding portion of the valve element. Since the operating piston of the eccentrically disposed exhaust valve strikes the pressure-receiving portion of the valve element of the exhaust valve, at a high speed, the pressure-receiving portion is subjected to an eccentric force and galling develops between the operating piston and the operating cylinder, so that contact sliding surfaces thereof may be damaged, and also this may adversely affect the smooth movement of the operating piston.

SUMMARY OF THE INVENTION

With the above rated deficiencies of the prior art in view, it is an object of this invention to provide an operating device for a gas circuit breaker in which the breaking and closing operations can be smoothly carried out at high speed without damaging an operating piston, an exhaust valve.

According to the present invention, a gas circuit breaker is provided which includes an operating cylinder having an exhaust port, with an operating piston being received in the operating cylinder so as to be reciprocably movable between a first position and a second position. The operating piston divides an internal space of the operating cylinder into a first chamber and a second chamber which are respectively disposed on opposite sides of the operating piston. The operating piston is movable from the first position to the second position at the time of a braking operation of the operating device and is movable from the second position to the first position at a closing operation of the operating device. An exhaust port is communicated with the first chamber when the operating piston is disposed near the second piston, and the exhaust port is communicated with the second chamber when the operating piston is removed from the second position. Means are provided for introducing high-pressure air into the first chamber at the time of the braking operation. Exhaust valve means discharge the air from the first chamber when the air pressure within the first chamber decreases below a predetermined level. The exhaust valve means includes a valve element having a pressure-receiving portion receiving the air pressure from the first chamber, and the pressure receiving portion is positioned such that the pressure-receiving portion is out of contact with the operating piston when the operating piston is disposed at the first position.

Other objects, features and advantages of the present invention will become more apparent when taken in connection with the accompanying drawings which show, for the purpose of illustration only, one embodiment in accordance with the present invention.

DETAILED DESCRIPTION OF THE PREFERRED EMBODIMENT

Figure 1:
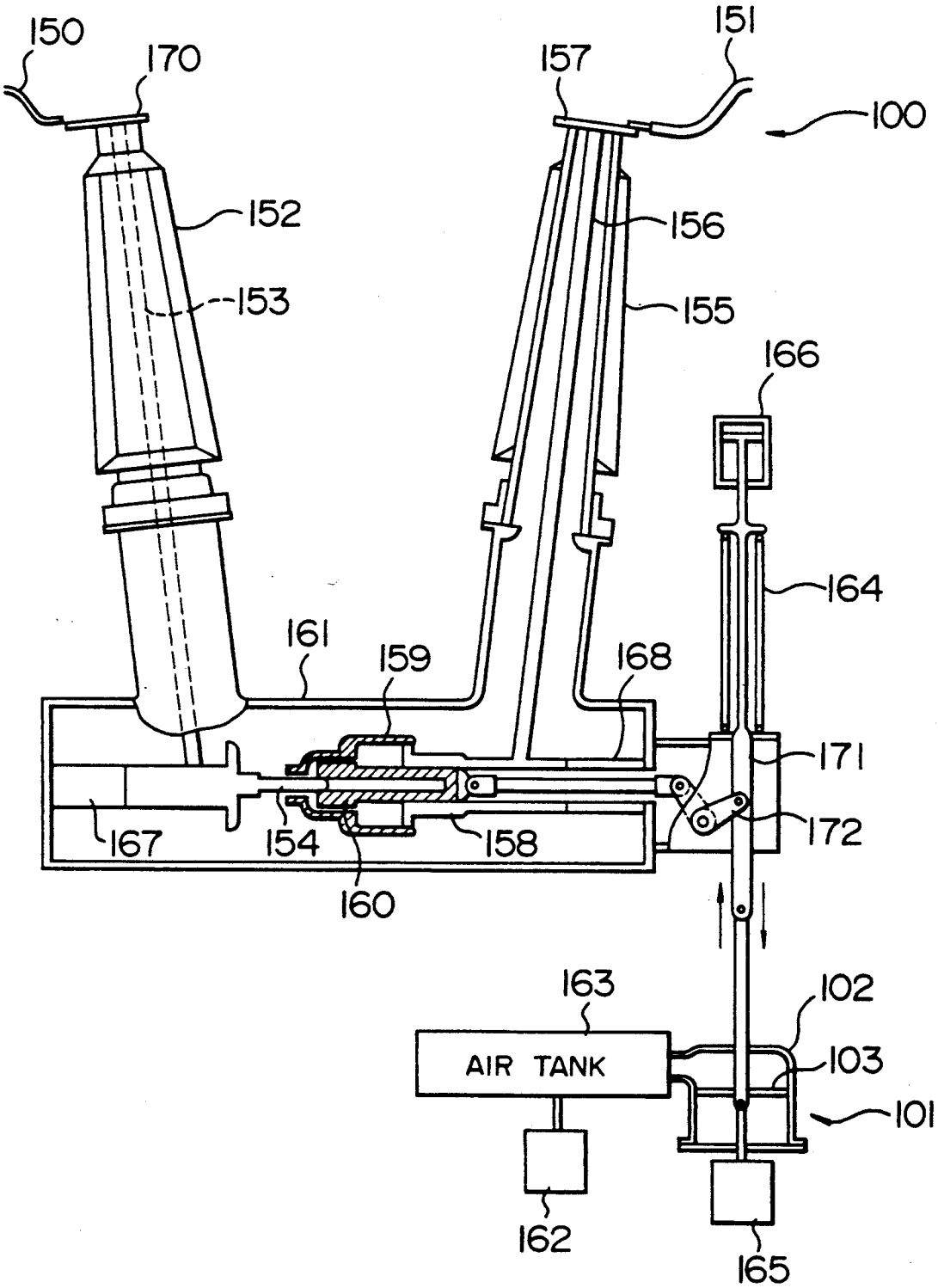
FIG. 1 PRIOR ART
FIG. 1 is a schematic view of a conventional gas circuit breaker of a general type.

As shown in FIG. 1 a conventional gas circuit breaker generally designated by the reference numeral 4, 100 aerial or overhead lines 150 and 151 are connected together, with the aerial line 150 being connected through a terminal 170 to an upper end of a conductor 153 extending through the interior of a bushing 152. The lower end of the conductor 153 is connected to a stationary contact 154. The aerial line 151 is connected through a terminal 157 to an upper end of a conductor 158 extending through an interior of a bushing 155. The lower end of the conductor 156 is connected through a fixed puffer piston 158 to a moving puffer cylinder 159. The puffer cylinder 159 has a hollow shaft 160 serving as a moving contact. $SF_6$ gas is filled in an interrupting tank 161, with an oil dash-pot 166 and insulating supports 167, 168 also being provided.

When abnormal current, accidental current, or the like occurs, a breaking magnetic valve device 162 receives an breaking instruction, and high-pressure air filled in an air tank 163 is fed into an operating cylinder 102 of an operating device generally designated by the reference numeral 101, so that an operating piston 103 is moved in a downward direction (FIG. 1). This downward movement of the operating piston 103 is transmitted to an operating rod 171, so that the operating rod 171 is moved downwardly, compressing a closing spring 164. At this time, the puffer cylinder, 159 and its hollow shaft 160 are moved to the right through a pivotal lever 172, thereby interrupting or breaking the connection between the stationary contact 154 and the moving contact 160. When the puffer cylinder 159 is moved in this manner, the $SF_6$ gas in the cylinder 159 is compressed and is discharged to the exterior, of the cylinder 159. The thus discharged $SF_6$ gas is blown in a direction of an arc produced between the stationary contact 154 and the moving contact 160 to thereby extinguish the arc. In this manner, the abnormal current or the accidental current is extinguished.

When a closing magnetic valve device 165 receives a closing instruction after the above breaking operation, the retaining of the piston 103 by a retaining element provided within the magnetic valve device 165 is released, so that the piston 103 and the operating rod 171 are moved in an upward direction under the influence of the closing spring 164. Therefore, the puffer cylinder 159 is moved to the left via the pivotal lever 172, so that the moving contact 160 is brought into contact with the stationary contact 154.

Figure 2:
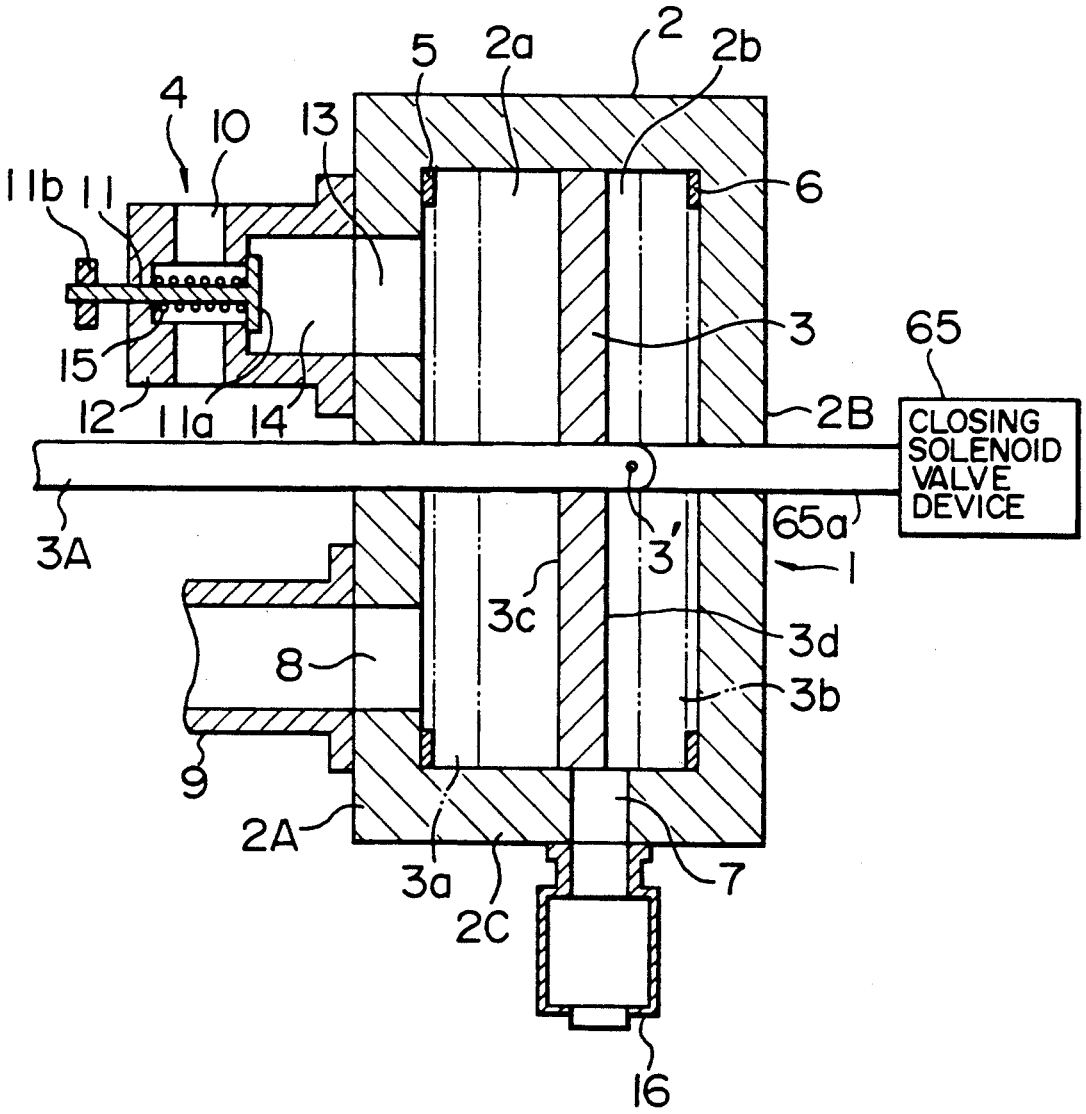
FIG. 2 is a cross-sectional view of an operating device for a gas circuit breaker provided in accordance with the present invention, showing a breaking operation.

In accordance with the present invention, as shown in FIG. 2, the operating device 1 comprises an operating cylinder 2 having front and rear (left and right in FIG. 2) end walls 2A and 2B and a peripheral wall 2C, an operating piston 3 having a rod 3A extending through the front end wall 2A of the operating cylinder 2, and an exhaust valve device generally designated by the reference numeral 4 fixedly mounted on the front end wall 2A and projected in the same direction as the direction of extending of the piston rod 3A. The operating piston 3 is reciprocably movable between a first position indicated by broken lines **3*a*, where the piston 3 abuts against a stopper 5 mounted on the inner surface of the front end wall 2A of the operating cylinder 2 and a second position indicated by broken lines 3*b*, where the piston 3 abuts against a stopper 6 mounted on the inner surface of the rear end wall 2B of the operating cylinder 2. The operating piston 3 has a first or front side face 3*c* and a second or rear side face 3*d*. The operating piston 3 divides the internal space of the operating cylinder 2 into a first chamber 2*a* on the front side of the piston 3 and a second chamber 2*b* on the rear side of the piston 3**.

An air supply pipe 9 is mounted on the front (left) side of FIG. 2 end wall 2A of the operating cylinder 2, and high-pressure air is introduced into the first chamber **2*a* via the air supply pipe 9 and a through hole 8 formed through the front end wall 2A. The air supply pipe 9 is connected to an air tank 163 (FIG. 1). An exhaust port 7 is formed through that portion of the peripheral wall 2C of the operating cylinder 2 disposed close to the rear end wall 2B. The exhaust port 7 is communicated with the atmosphere via a muffler 16. When the operating piston 3 is not disposed close to the second position 3*b*, the exhaust port 7 is in communication with the second chamber 2*b* of the operating cylinder 2 on the rear side (right side of FIG. 2) of the piston 3. When the operating piston 3 is moved to a position close to the second position 3*b*, the exhaust port 7 is communicated with the first chamber 2*a* of the operating cylinder 2**.

The exhaust valve device 4 comprises a housing 12 and a valve element 11. The housing 12 has an inlet chamber 14 communicated with the first chamber **2*a* via a through hole 13 formed through the front end wall 2A of the cylinder 2, and a valve port 10. The valve element 11 is provided between the inlet chamber 14 and the valve port 10. The valve element 11 has a pressure-receiving portion 11*a* disposed in the inlet chamber 14, and a stopper 11*b*. The valve element 11 is normally urged by a spring 15 in a direction shown in FIG. 3 so as to communicate the inlet chamber 14 with the valve port 10. The valve element 11 is arranged in such a position that, when the piston 3 is in the first position 3*a*, the piston 3 is not in contact with the pressure-receiving portion 11*a* of tee valve element 11**.

When abnormal current, accidental current, or the like occurs, a breaking solenoid valve device 162 (see FIG. 1) receives a breaking instruction, the high-pressure air is supplied from the air tank 163 (FIG. 1) to the first chamber **2*a* via the air supply pipe 8 to move the operating piston 3 to the right. At this time, the air pressure within the first chamber 2*a* acts on the inlet chamber 14 via the through hole 13 to urge the pressure-receiving portion 11*a* of the valve element 11 of the exhaust valve device 4 to the left with a force greater than the right urging force of the spring 15. Therefore, the valve element 11 is moved to its closed position (FIG. 2) where the communication between the inlet chamber 14 and the valve port 10 is interrupted. Until the operating piston 3 is moved near the second position 3b, that is, until the final stage of the breaking operation, the exhaust port 7 of the operating cylinder 2 maintains communication with the second chamber 2b. Therefore, during the movement of the operating piston 3 in the right-hand direction, the high-pressure air within the first chamber 2a is not discharged therefrom, whereas, the air is discharged from the second chamber 2b via the exhaust port 7, so that the movement of the operating piston 3** is carried out efficiently at high speed.

When the operating piston 3 is moved near the second position 3b that is, at the final stage of the breaking operating, the operating piston 3 passes past beyond the exhaust port 7 so that the exhaust port 7 is communicated with the first chamber 2a. Therefore, the high-pressure air within the first chamber 2a is discharged to the atmosphere, so that the pressure within the first chamber 2a decreases. When the pressure within the first chamber 2a decreases below a predetermined level, the left urging force acting on the pressure-receiving portion 11a of the valve element 11 of the exhaust valve device 4 becomes less than the right urging force of the spring 15, so that the valve element 11 is moved to its open position (FIG. 3) where the inlet chamber 14 is communicated with the valve port 10. In this manner, at the final stage of the breaking operation, that is, at the stage close to the time of the completion of the breaking operation, the air within the first chamber 2a is abruptly discharged efficiently through the exhaust port 7 and the exhaust valve device 4.

At the time of the re-closing operation subsequent to the above breaking operation, the operating piston 3 is moved in the left direction. In this case, the air supply pipe 9 is closed, and the air is not supplied to the first chamber 2a from the air supply pipe 9. At this time, the exhaust valve device 4 is in its open condition; therefore, as the operating piston 3 moves to the left, the air within the first chamber 2a is discharged through the exhaust valve device 4. Therefore, the pressure within the first chamber 2a is not increased when the piston 3 moves in the left direction, and his movement can be carried out smoothly and efficiently. During this closing (re-closing) operation and during the time period from the end of this closing operation to the start of the next breaking operation, the exhaust valve device 4 is kept in its open condition.

Figure 3:
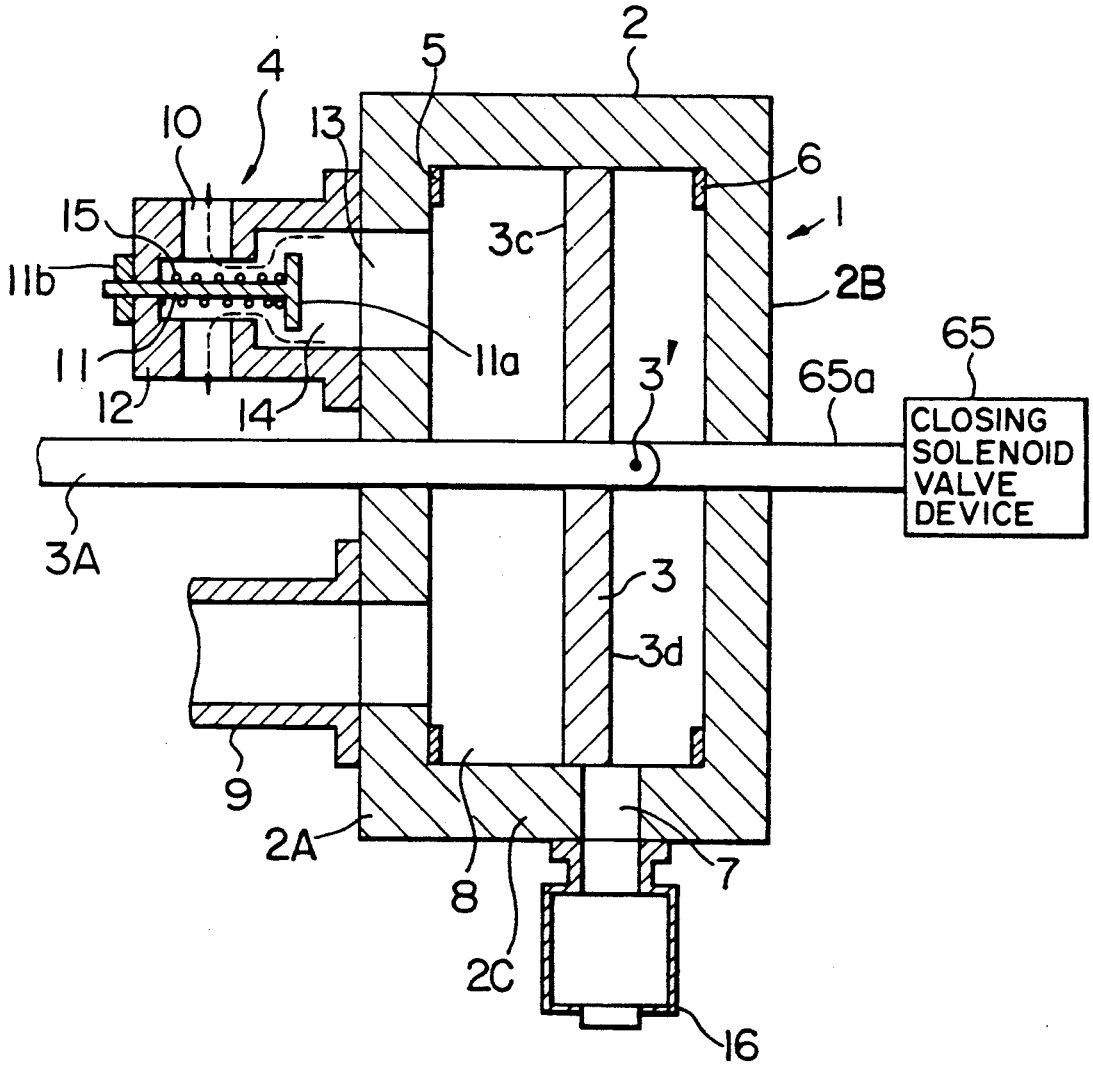
FIG. 3 is a cross-sectional view of the operating device of FIG. 2, but showing a closing operation.

Although not shown in FIGS. 2 and 3, the operating device 1 operates in association with various parts similar to the operating rod 171, the closing spring 164, etc., of the conventional device of FIG. 1. The closing operation of the operating device 1 is carried out in response to an instruction fed from a closing magnetic valve device 65 similar to the closing magnetic valve device 165 (FIG. 1). Any suitable conventional mechanism can be used for operatively connecting this magnetic valve device 65 to the operating piston 3. In FIGS. 2 and 3, an output rod 65a of the closing magnetic valve device 65 extends through the end wall 2B of the operating cylinder 3, and is connected at its left end to a part 3' of the operating piston 3. However, for example, the distal end of the output rod 65a of the closing magnetic valve device 65 may be connected through a suitable lever device or the like to that portion of the rod 3A of the operating piston located outside the operating cylinder 2.

As described above, in the present invention, by suitably controlling the exhaust or discharge of the air from the first and second chambers of the operating cylinder disposed respectively on the opposite sides of the operating piston, the breaking operation and the closing operation can be carried out efficiently at high speed. Further, since the air is abruptly discharged from the first chamber at the final stage of the breaking operation, the shift from the breaking operation to the closing operation can be made at high speed. Further, since the high-pressure air within the first chamber 2a is not discharged during the time period from the start of the breaking operation to the final stage of this breaking operation, the high-pressure air can be utilized without any waste, and therefore the air tank 163 (FIG. 1) can be of a smaller-size.

Particularly, in the present invention, when the operating piston 3 is moved to the first position 3a at the time of the completion of the closing operation, the operating piston 3 is not brought into contact with the valve element 11. Therefore, the above-mentioned drawbacks encountered with the prior art disclosed in Japanese Patent Unexamined Publication No. 54-101168 can be eliminated.

In the illustrated embodiment, the exhaust valve device 4 projects in the same direction as the direction of extending of the piston rod 3A. Therefore, advantageously, the exhaust valve device 4, thus arranged, will not be an obstructive projection in contrast with the case where this exhaust valve device is so provided as to project from the rear end wall 2B of the cylinder 2.

What is claimed is:

1. An operating device for a gas circuit breaker, the operating device comprising:

an operating cylinder having an exhaust port;

and an operating piston having one end operatively connected to the gas circuit breaker for effecting a breaking operation and closing operation, said operating piston being received in said operating cylinder so as to reciprocably move between a first position and a second position, said operating piston dividing an internal space of said operating cylinder into a first chamber and a second chamber respectively disposed on opposite sides of said operating piston, said operating piston being movable from said first position to said second position at a time of the breaking operation of said operating device, said operating piston being movable from said second position to said first position at a time of the closing operation of said operating device, an exhaust port communicating with said first chamber when said operating piston is disposed near said second position, and said exhaust port communicating with said second chamber when said operating piston is remote from said second position;

means for introducing high-pressure air into said first chamber at the time of said breaking operation; and exhaust valve means for discharging the air from said first chamber when the air pressure within said first chamber decreases below a predetermined level, said exhaust valve means including a valve element having a pressure-receiving portion which receives the air pressure from said first chamber, and wherein said pressure-receiving portion is positioned so that said pressure-receiving portion is out of contact with said operating piston when said operating piston is disposed at said first position.

2. An operating device according to claim 1, wherein said operating cylinder has a pair of end walls, said operating piston has a piston rod extending through one of said pair of end walls of said operating cylinder, and wherein said exhaust valve means is fixedly mounted on said one end wall and projects in the same direction as an extension direction of said piston rod.

3. An operating device according to claim 1, wherein said exhaust valve means includes a housing having an inlet chamber in communication with said first chamber, and a valve port, said valve element being provided between said inlet chamber and said valve port in such a manner that said pressure-receiving portion is disposed in said inlet chamber, and wherein said exhaust valve means further includes a spring for normally urging said valve element in a direction so as to communicate said inlet chamber with said valve port.

* * * * *